United States Patent [19]

Casey et al.

[11] 4,135,946

[45] Jan. 23, 1979

[54] PROCESS AND APPARATUS FOR ENHANCING GROWTH OF PRECIPITABLES IN A CHEMICAL SOLUTION

[76] Inventors: John A. Casey, 1755 Beach St., San Francisco, Calif. 94123; Ismael E. Rojas, 17 Calle A 7-09 Zona 10, Guatemala, Guatemala

[21] Appl. No.: 874,733

[22] Filed: Feb. 3, 1978

[51] Int. Cl.[2] ..... C13D 3/02

[52] U.S. Cl. ..... 127/11; 127/9; 127/48; 127/57; 210/53; 210/199; 210/519; 210/534

[58] Field of Search ..... 127/9, 11, 48, 57; 210/53, 56, 199, 519, 534

[56] References Cited

U.S. PATENT DOCUMENTS

| | | | |
|---|---|---|---|
| 2,152,863 | 4/1939 | Bills | 210/519 X |
| 2,175,563 | 10/1939 | Green | 210/519 |
| 2,520,957 | 9/1950 | Peterson | 127/11 |
| 2,593,036 | 4/1952 | Koch | 210/519 X |
| 3,508,965 | 4/1970 | Harrison | 127/55 X |
| 3,853,616 | 12/1974 | Rundell | 127/57 X |
| 3,963,513 | 6/1976 | Casey | 127/11 |
| 3,965,013 | 6/1976 | Jackson | 210/534 X |
| 3,979,290 | 9/1976 | Loffler | 210/534 X |
| 4,000,001 | 12/1976 | Toth | 127/9 X |
| 4,001,116 | 1/1977 | Selcukoclu | 210/534 X |

*Primary Examiner*—Sidney Marantz

*Attorney, Agent, or Firm*—Townsend and Townsend

[57] ABSTRACT

A method and apparatus for enhancing growth of precipitates in systems requiring separation of undesirable contaminants. Cane sugar juice, as exemplary, is introduced at an elevated temperature into an apparatus having means for separately introducing chemical treating agents, such as milk of lime and coagulants. The juice flows through a treating zone where the agents are introduced, into a holding zone and over a dispersion cone before being withdrawn from the holding zone by a siphoning means. The dispersion cone and holding zone bottom permit rapid growth of the insoluble particles while simultaneously diverting the flow direction gently so as to prevent breakup of the particles. The flow down through the treating zone, over the dispersion cone, down the conical holding zone bottom, and back up the siphoning means permits sufficient residence time for rapid growth of the insoluble particles so that coagulants need not be added in the subsequent clarification process. A mild vacuum may be maintained within the apparatus for enhancing deaeration of the solution.

25 Claims, 3 Drawing Figures

PROCESS AND APPARATUS FOR ENHANCING GROWTH OF PRECIPITABLES IN A CHEMICAL SOLUTION

BACKGROUND OF THE INVENTION

Juice from cane sugar has been conventionally clarified by the application of lime and heat followed by extended settling in large tanks. More recently, chemical polyacrylamides have been used to accelerate the coagulation and settling of these cane sugar juices, both in conventional large clarifying tanks and in smaller specially designed tanks to take advantage of the accelerated coagulation provided by polyacrylamide.

The nature of cane sugar juice is that the insoluble solids, which are precipitated by the conventional addition of lime and application of heat, are gummy and sticky. In addition, the natural variation in cane juice quality is such that the physical characteristics of the precipitate are variable. This variation makes it difficult to provide equipment, which will allow the clarification of cane sugar juice in the fastest manner when treated with polyacrylamide.

In normal processing, cane sugar juice is limed and heated with the pH of the juice increasing from a range of 5.0–6.5 to about 6.8–7.5. After liming, a dilute solution of polyacrylamide is then added to the juice to enhance coagulation. Various rapid clarifying apparatuses may be employed such as the "EIS Rapid Clarifier," U.S. Pat. No. 2,679,464; I.S.J. 1955, 57, 25 or the "SRI Clarifier," developed by the Sugar Research Institute of Australia.

Applicant's previously issued patent, U.S. Pat. No. 3,963,513, discloses a method and apparatus for increasing precipitate formation in cane sugar juice processing by treating downwardly flowing juice with milk of lime in a treating zone, and reducing the flow rate of the juice in a holding zone in a manner so as to avoid both the breakup of the particles and the settling out of those particles from the juice.

SUMMARY OF THE INVENTION

The present invention provides a substantial improvement over the apparatus and process disclosed in the 3,963,513 patent. In a cylindrical tower is mounted a conical funnel having an outlet conduit extending downwardly and opening generally at the middle portion of the tower. A perforated spiral tube is circumferentially nested in the conical funnel for the addition of milk of lime to the downwardly flowing cane sugar juice. A perforated helical tube is nested in the outlet conduit for the addition of a coagulant such as polyacrylamide.

In purifying cane sugar juice, the juice is first treated with a salt mixture, optionally followed by liming to a pH of about 6.5, and heated to above the boiling point of water, usually not exceeding about 230° F. The hot cane sugar juice stream is slowly moved, as a relatively thin film through the liming zone, where lime is continuously and incrementally introduced into the juice, while vapor is removed overhead. The pH of the cane sugar juice is increased to not greater than about 7.5. From the liming zone, i.e., the funnel, the juice flows down the outlet conduit where the polyacrylamide is added to enhance the growth of the insoluble particles or floccules. Upon leaving the outlet conduit the juice enters the holding zone by flowing over a dispersion cone and outward toward the outer wall of the tower. The dispersion cone has holes to permit some of the juice to pass through. The construction of the holding zone permits gentle nonturbulent flow within the tower, thus preventing the breakup of the floccules. The bottom of the tower is of an inverted conical shape so that the coagulated particles tend to congregate in one general location. A vacuum is generally maintained in the holding zone to aid in deaerating the juice; thus preventing the formation of air bubbles and their concomitant detrimental effect on the subsequent clarification of the juice. The juice and coagulated particles are siphoned out of the tower to a clarifier through a conduit which is inside the funnel outlet conduit and generally concentric therewith.

By adding polyacrylamide to the juice and flowing the juice over the dispersion cone, the precipitables coagulate into floccules of sufficient size that polyacrylamide need not be added in the clarifier. The dispersion cone and conical tower bottom permit the floccules to roll towards the side of the tower and toward the bottom, thus creating a "snowballing" effect which facilitates the growth of the floccules.

DESCRIPTION OF THE SPECIFIC EMBODIMENTS

Figure 1:
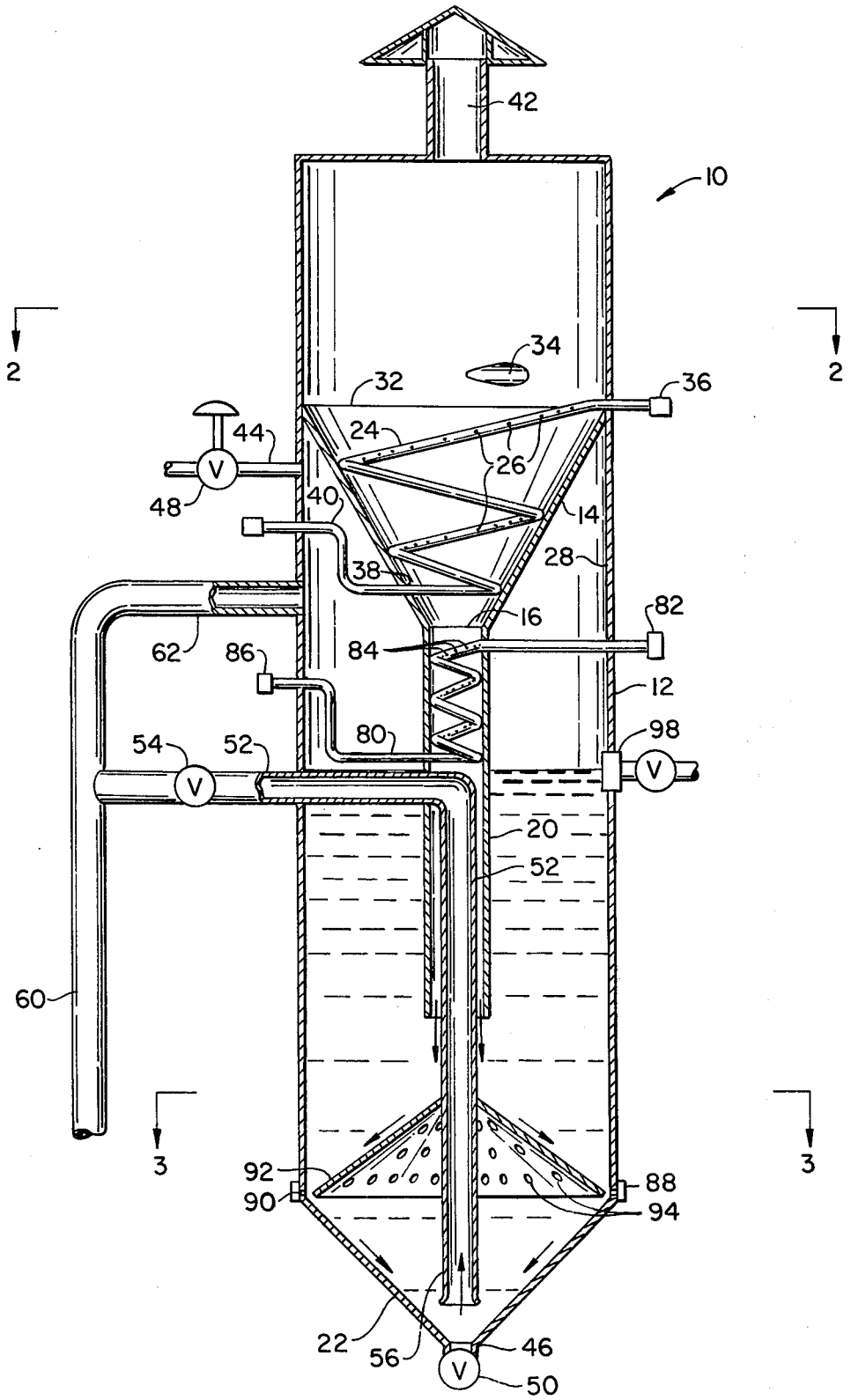
FIG. 1 is an elevational cross section of the chemical treatment and deaeration tower of this invention.

A method and apparatus are provided for the chemical treatment and deaeration of a solution having undesirable precipitable contaminants, as is found, for example, with cane sugar juice. The apparatus is conveniently a cylindrical tower with an overhead vent and a conical funnel fitted into an upper portion of the tower. The funnel connects to an outlet conduit which opens generally at the midpoint of the tower. A perforated spiral tube of an inert material, e.g. plastic, is circumferentially nested in the conical funnel extending from an upper portion of the conical funnel to a lower portion adjacent the outlet connected to the outlet conduit.

Connecting means are provided for connecting the spiral tube to a source of a chemical treatment solution at the upper end of the spiral and to an outlet conduit for any excess solution to be discarded or recycled. Means are provided in an upper portion of the tower beneath the rim of the funnel for connecting to a vacuum source and regulating the internal pressure of the tower beneath the funnel. Solution inlet means is provided adjacent an upper portion of the conical funnel, so that the solution is introduced in a substantially horizontal direction and follows a relatively spiral path about the cone.

Means are provided for introducing additional chemicals such as coagulants, into the solution. Preferrably a perforated helical tube is nested in the outlet conduit from the funnel for introducing such chemicals. Alternatively, these chemicals may be added by means of a annular ring located around the outer wall of the tower in which the chemicals pass through the ring and into the tower through a plurality of openings circumferentially spaced around the wall.

Near the output end of the outlet conduit is a dispersion cone which facilitates the growth of the precipitables by creating a "snowballing" effect. That is, as the particles roll over the dispersion cone generally toward the wall of the tower, and then up and/or down the conical tower bottom, they grow in size. Furthermore, the dispersion cone and the conical tower bottom provide an extended flow length which improves the amount and quality of flocculation. The conical shape of the dispersion cone and the tower bottom creates less flow turbulence than towers where the outlet conduits exit directly to a flat tower bottom since a sinuous path is provided where the direction of flow is changed much less abruptly.

The solution and the coagulated particles within it are withdrawn from the tower by a siphoning means having an inlet near the conical tower bottom. The flow rate out of the tower may be varied by a valve in the siphoning line so as to vary the residence time within the tower as desired by the particular type of solution being treated.

A debris outlet is provided generally at the level where the siphon pipe exits the tower for either continuously or intermittently removing floating debris and foam.

In employing the subject apparatus with cane sugar juice, the cane sugar juice may be first treated with a small amount of a salt mixture. The salt mixture will normally include sodium aluminate, aluminum sulphate, trisodium phosphate and sodium tri-polyphosphates, generally added to the juice in total amount of not more than about 250 ppm. The exact composition and amount employed will depend upon the particular quality of the juice being treated at the time, the salts aiding in the controlled growth of hydroxides and calcium phosphates during the liming of the hot cane sugar juice.

Lime is optionally added prior to introduction into the deaeration tower to provide a pH of about 6.5. The cane sugar juice as initially provided will generally have a pH in the range of about 5.0–6.5 and may be treated with milk of lime (1–15 weight percent) to bring the pH to about 6.5. After mixing the cane sugar juice with the salt mixture and optionally lime, the juice is heated to a temperature above the boiling point of water (212° F.) and below about 230° F., normally about 220° F. The cane sugar juice stream then flows through an extended path, while dissolved gases and water vapor flash off.

The extended path is achieved in the subject apparatus by introducing the cane sugar juice stream under pressure tangentially to the conical funnel, so that the initial flow is horizontal. The cane sugar juice then swirls about the cone in a spiral path substantially as a thin film. Milk of lime is continuously and incrementally introduced into the cane sugar juice stream by a spiral perforated feed pipe nested in the conical funnel. The pH of the cane sugar juice is raised to a pH in the range of about 6.8–7.5, as required by the particular juice undergoing treatment to achieve the desired settling characteristics of the precipitate and the clarity of the juice. The amount of lime necessary to achieve the pH is controlled by continually sampling the juice being discharged from the tower.

After exiting from the funnel, which serves as a liming and deaerating zone, the cane sugar juice stream flows by gravity through an outlet conduit. Polyacrylamide, or other suitable coagulant, is added to the flowing juice within the conduit by means of a perforated helical pipe nested within the conduit. Alternatively, the coagulant may be added by means of an annular ring located around the outer wall of the tower and communicating with the tower interior through a plurality of circumferentially spaced openings in the tower wall. The solution of polyacrylamide is normally diluted in water to concentrations of about 0.001 to 0.1 weight percent and is added in amounts based on polyacrylamide of about 0.25 to 5.0 ppm based on cane sugar juice weight.

The output end of the outlet conduit is located substantially above the bottom of the tower. As the juice exits from the outlet conduit, it flows into the holding zone over a downwardly diverging dispersion cone towards the wall of the tower and then generally down the invertedcone-shaped tower bottom. The holding zone serves as a particle forming zone and by significantly increasing the distance which the cane sugar juice stream must flow, the extent and quality of flocculation is improved. Thus the shape of the dispersion cone and conical tower bottom not only increase the distance which the juice stream must flow, but also creates a "snowballing" effect in that the particles grow in size as they roll over the conical surfaces. Furthermore, it has been found that this construction of the holding zone creates far less turbulence than prior art towers in which the stream exits directly onto a flat surface of the tower bottom. The conical shape of the dispersion cone and tower bottom change the flow stream direction only through relatively shallow angles. The avoidance of turbulence is highly desirable since turbulent action in the tower breaks up and reduces the size of the floccules.

Removal of water vapor and gases may be enhanced by applying a vacuum in the holding zone, generally 1–2 inches mercury. The deaeration of the juice which is achieved is of great significance during the further processing. Air bubbles forming in the subsequent clarification is a detriment to clarifier performance. The air bubbles combine with particles of insoluble solids causing them to rise through the clarifier and overflow with the clear juice, instead of the particles settling rapidly to the bottom of the tower.

The cane sugar juice and the coagulated particles within it are then withdrawn from the holding zone through a siphoning pipe having an inlet near the conical tower bottom. The juice flows upwardly through the siphoning pipe and out to a clarifier where the coagulated particles settle out of the solution. The siphoning means maintains continuous flow in the holding zone so as to avoid settling of the insoluble particles from the juice within the holding zone. A valve in the siphoning pipe allows the flow rate and thus the residence time in the holding zone to be varied as desired.

For further understanding of the subject invention, the drawings will now be considered.

In FIG. 1, the treating tower 10 has a cylindrical tower 12. The tower should be well insulated to reduce heat losses. Fitted in the tower is a conical funnel 14 whose outlet 16 is connected to outlet conduit 20, which extends vertically downward. Nesting in funnel 14 is spiral tube 24 having a plurality of perforations 26 along its length. The tube 24 is conventionally an inert plastic tube, which is circumferentially clamped to the inner wall 30 of conical funnel 14. The circumferential tube serves as a feed tube for the continuous and incremental addition of a chemical treating solution. In this manner, thorough and uniform mixing is achieved without high localized concentrations occurring. The rim 32 of the funnel forms a tight seal with the inner wall 28 of the tower 12.

Adjacent the rim 32 of the conical funnel 14 is a tangential inlet 34, which feeds the feedstock solution horizontally into the conical funnel 14. The path of the feedstock through the funnel is therefore substantially a spiral path, so that a relatively thin stream has an extended path and extended residence time in the funnel. The spiral nature of the path is further augmented by the spiral shape of the chemical treating solution feed tube 24. The feed tube 24 is connected to inlet conduit 36, and outlet conduit 40, both of which extend through the wall of tower 12 and are sealed to the wall to prevent air leakage. Outlet conduit 40 extends through opening 38 in the conical funnel to connect with feed tube 24. The outlet conduit 40 is bent upwardly in an S shape, so as to provide a hydrostatic pressure head to encourage the flow of the chemical treatment solution out of the perforations 26.

A vent 42 is provided through which vapors may exit. A vacuum outlet 44 is provided below the conical funnel rim 32 for reducing the pressure in the lower portion of the tower with vacuum regulating gauge 48 provided, for controlling the level of the vacuum in the tower. Adjacent to tower bottom 22 is drain conduit 46 fitted with valve 50. The drain conduit 46 provides for ease of cleaning of the tower.

At an intermediate distance from the tower bottom 22 is siphon pipe 52 fitted with valve 54, which is connected to tower outlet pipe 60. Above siphon pipe 52 is the emergency discharge outlet 62, which provides for the maximum height level of the treated solution in the tower 12. Discharge outlet 62 empties into outlet pipe 60.

The solution level in the tower may be monitored by viewing windows strategically placed in the tower wall.

Figure 2:
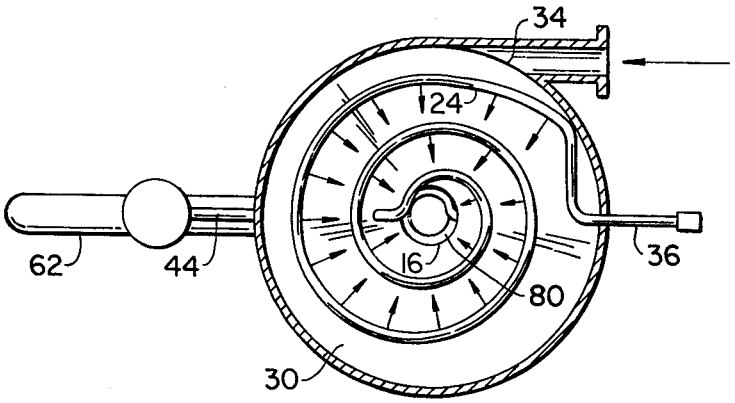
FIG. 2 is a plan view along lines 2—2 of FIG. 1.

In FIG. 2 is seen the feedstock inlet conduit 34 which feeds the feedstock with sufficient centrifugal force so that a spiral path occurs along wall 30. The spiral tube 24 feeds the chemical treating solution continuously as the feedstock moves downwardly toward outlet 16. In this manner localized high concentrations of the chemical treating solution is introduced into the feedstock. This allows for uniform distribution of the chemical treating solution into the feedstock. The spiral path of the feedstock enhances the residence time for deaeration and treatment and allows for a slow controlled buildup of the chemical treating agent in the solution being treated.

A helical tube 80 having a plurality of perforations 84 is located within outlet conduit 20 and is used to supply a coagulant to the downwardly flowing solution. The helical tube 80 is connected to inlet conduit 82 and outlet conduit 86, both of which extend through the tower 12 and are sealed to the wall to prevent air leakage. In an alternative embodiment, an annular ring 88 located around the tower wall may be used to supply coagulant or other chemicals to the solution through a plurality of openings 90 in the tower wall.

Figure 3:
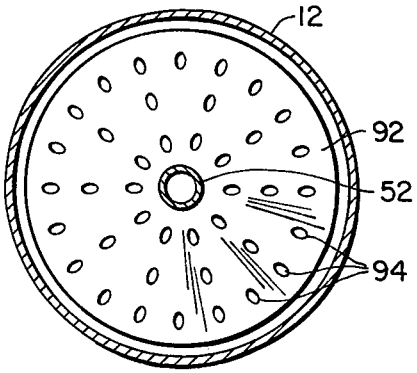
FIG. 3 is a plan view along lines 3—3 of FIG. 1.

As the solution exits outlet conduit 20, it is directed over dispersion cone 92 toward the tower wall and then generally down the conical tower bottom 22. In FIG. 3 is seen the dispersion cone 92 in a top view. The cone surrounds siphon pipe 52 through which the solution exits from the tower. The cone has a plurality of openings 94 which serve the purpose of preventing a dead space beneath the cone. Thus a part of the solution exiting conduit 20 will pass through the openings while the remainder will generally pass over the dispersion cone toward the outer wall.

The direction of flow is assisted by the siphoning action which tends to direct the solution toward the tower bottom 22 and into siphon inlet 56. The siphon pipe 52 is located within outlet conduit 20 and is generally concentric therewith. Siphon pipe 52 passes through the wall of outlet conduit 20 and the wall of the tower 12, after which it connects to outlet pipe 60. Valve 54 is siphon pipe 52 permits the flow rate of the exiting solution to be varied as desired. While siphoning is preferred, it should be apparent that any method of removing the solution will suffice provided the flow is gentle enough to prevent breakup of the particles.

The above-described treatment tower, and specifically the means for adding chemicals, the construction of the dispersion cone and tower bottom, and the use of a siphoning means, provides marked improvements over prior art towers. For example, in the treatment of cane sugar juice, the extended flow path length caused by the dispersion cone and tower bottom improves the extent and quality of floccule formation. This improved feature allows coagulant, such as polyacrylamide, to be added within the tower. The coagulant in turn enhances growth of the precipitated particles, which grow even larger because of the "snowballing" effect of flowing over the dispersion cone and tower bottom. Because of the extended path length and the flocculation enhanced by the dispersion cone, the residence time of juice within the tower can be minimized. Sufficient particle formation and growth may be achieved with a residence time of about one minute. Turbulence and the concomitant breakup of the floccules is avoided by the gental diversion of the flow path around the dispersion cone. Yet continuous flow is maintained by the siphoning means so as to prevent settling of the floccules in the holding zone.

A debris outlet 98 may be provided for the removal of undesirable solid particles which rise to the surface. For example, in the treatment of cane sugar juice, baggasillio, including cane fibers and leaves, tends to discolor the juice and it is thus desirable to remove this debris as soon as possible, i.e. before the juice is passed to the clarifier. By adjusting valve 54, the level of juice is maintained at a height to permit debris to be withdrawn through outlet 98.

Foam and floating fine baggasillio may be removed by removing up to about 20% of the cane sugar juice through outlet 98. The baggasillio may then be filtered out and the juice either recycled back into the tower or directed to the clarifier.

With cane sugar juice, controlled buildup of precipitates with concommitant deaeration is achieved. The removal of the dissolved gases prevents the subsequent formation of air bubbles during clarification which entrain precipitate particles when rising to the surface, which result in the precipitate particles overflowing with the clarified cane sugar juice.

Although the foregoing invention has been described in some detail by way of illustration and example for purposes of clarity of understanding, it will be obvious that certain changes and modifications may be practiced within the scope of the appended claims.

What is claimed is:

1. A method for treating in a treatment tower a chemical solution to enhance the growth and coagulation of undesirable precipitables which comprises the steps of:

introducing said solution generally at the upper end of said tower;

directing the flow of said solution so that said solution flows downwardly as a relatively thin film through a generally extended path;

introducing a first chemical treating agent into said downwardly flowing film of solution;

introducing a second chemical treating agent into said solution after said solution has completed its extended downward path;

diverting the flow of the treated solution downwardly over a diversion structure within the lower portion of said tower and outwardly toward the wall of said tower whereby turbulence of the flowing solution is prevented and whereby the precipitables generally coagulate as they pass over said structure;

removing said solution from said tower so as to prevent the settling of the coagulated particles within the tower; and adjusting the rate at which said solution is removed from the tower so as to vary the residence time of the solution within said tower.

2. A method according to claim 1 including the step of reducing the pressure within said tower for facilitating the deaeration of said solution.

3. A method according to claim 1 wherein the step of directing the flow comprises the step of directing the flow through a downwardly converging spiral path and wherein the step of introducing said solution comprises the step of injecting said solution tangentially at the upper end of said downwardly converging spiral path.

4. A method according to claim 3 wherein the step of introducing the first treating agent further comprises the step of incrementally adding said first treating agent along said downwardly converging spiral path.

5. A method according to claim 4 wherein the step of introducing said second treating agent further comprises the step of incrementally adding said second treating agent to said solution after said solution has completed said downwardly converging spiral path.

6. A method according to claim 5 wherein the step of incrementally adding said second treating agent further comprises the steps of directing the flow exiting said spiral path to a generally downward helical path and incrementally adding said second treating agent along said helical path.

7. A method according to claim 1 wherein the step of removing said solution further comprises the step of siphoning said solution generally from the bottom of said tower.

8. A method according to claim 1 wherein the step of adjusting the rate of removal further comprises the step of adjusting the rate of removal until the solution has reached a predetermined level within said tower and including the step of withdrawing floating debris from the surface of said solution when said solution has reached said predetermined level.

9. A method for treating cane sugar juice for enhancing the growth of undesirable precipitables and the coagulation of same in a treating tower of the type having a cone shaped funnel with a spiral perforated tube nested therein, said funnel being generally located at the upper end of said lower, and a downwardly diverging conical structure generally located at the lower end of said tower, which comprises the steps of:

introducing the juice tangentially proximate the upper rim of said funnel so that the juice flows as a generally thin film in a downward spiral path towards the exit of said funnel;

introducing milk of lime through said spiral tube and into the downwardly flowing juice film initially at a temperature above the boiling point of water, to raise the pH of said solution to a final pH in the range of about 6.8–7.5;

introducing a coagulant into the limed juice after the limed juice exits the funnel;

diverting the flow of juice over said downwardly diverging conical structure and toward the outer wall of said tower whereby the precipitated particles grow in size as they pass over said structure; and siphoning the cane sugar juice and the precipitated particles generally from the bottom of said tower whereby by continuous and nonturbulent flow upwardly breakup of the coagulated particles is prevented.

10. A method according to claim 9 including the step of reducing the pressure within said tower for enhancing the deaeration of the cane sugar juice.

11. A method according to claim 9 including the step of removing undesirable cane sugar leaves and fibers from the surface of the juice within said tower.

12. A method according to claim 9 wherein the step of introducing the coagulant further comprises the steps of directing the limed juice exiting said funnel through a generally downward helical path and introducing said coagulant incrementally along said helical path.

13. A method according to claim 9 wherein the step of introducing the coagulant further comprises the step of introducing polyacrylamide.

14. A method according to claim 9 including the step of adjusting the rate of flow out of the tower so as to vary the residence time of the cane sugar juice within the tower.

15. A method according to claim 14 wherein the step of adjusting further comprises the step of adjusting the rate of flow until the juice reaches a predetermined level within the tower and including the step of withdrawing baggasillio and foam generally from the surface of the juice when the juice has reached said predetermined level.

16. A treating tower for the chemical treatment of a solution to induce growth and coagulation of undesirable precipitables which comprises:

a conical funnel in an upper portion of said tower opening into a vertical exit conduit;

spiral tubular feeding means, perforated along its length, nesting in said conical funnel and having inlet and outlet conduit means for receiving and discharging a first treating agent;

means for introducing a second treating agent to the solution after it has exited said funnel;

means proximate the lower end of said vertical exit conduit for gently diverting the flow of the treated solution outwardly toward the outer wall of said tower whereby the precipitables grow in size as they pass over the surface of said diverting means; and means for removing the solution and the coagulated precipitables from a lower portion of said tower whereby breakup of the coagulated precipitables is prevented.

17. Apparatus according to claim 16 wherein the means for introducing a second treating agent further comprises a helical shaped tube having a plurality of perforations along its length and nested within said vertical exit conduit, said helical tube having an input end for the passage of said second treating agent.

18. Apparatus according to claim 16 wherein the means for introducing said second treating agent further comprises an annular ring located around the circumference of said tower and a plurality of openings in the tower wall for communicating with said ring, said ring having an inlet for the passage of said second treating agent.

19. Apparatus according to claim 16 wherein said diverting means is a downwardly diverging cone and wherein the bottom of said tower is shaped as a generally upwardly diverging cone, whereby the solution exiting the conduit flows generally outwardly toward the wall of the tower and downwardly toward the tower bottom thereby extending the path length of the flowing fluid.

20. Apparatus according to claim 16 wherein the removing means is a siphon pipe having an inlet proximate the bottom of said tower whereby the solution and the coagulated precipitables pass gently upwardly through said siphon pipe thereby preventing the break up of the coagulated precipitables.

21. Apparatus according to claim 16 including means connected to said removing means for adjusting the rate of removal of the solution from said tower.

22. Apparatus according to claim 19 wherein said cone has a plurality of openings for permitting the passage of a portion of said solution through said cone thereby preventing the stagnation of flow beneath said cone.

23. Apparatus according to claim 16 including means for reducing the pressure within said tower for enhancing the deaeration of said solution.

24. Apparatus according to claim 16 including means for withdrawing floating debris from the surface of said solution.

25. An improved cane sugar juice treatment tower for enhancing the growth of undesirable precipitables prior to clarification, the tower being of the type having a conical funnel and perforated spiral tubing nested therein in an upper portion of the tower and a vertical exit conduit intermediate the exit of said funnel and the generally lower portion of the tower, wherein the cane sugar juice enters tangentially at the upper rim of the funnel and travels downwardly as a film in a generally spiral path past the spiral tubing where milk of lime is introduced into the flowing film, wherein the improvement comprises:

a helical tube having a plurality of perforations along its length and nested within the vertical exit conduit for introducing a coagulant into the limed juice exiting the funnel;

a downwardly diverging dispersion cone for diverting the coagulant-treated limed juice toward the wall of said tower, whereby the size of the coagulated precipitables increases as the juice passes over the surface of said dispersion cone;

an upwardly diverging conically shaped tower bottom for extending the path of flow of the juice whereby the coagulated precipitables grow further in size as they pass over the surface of said tower bottom;

a siphon pipe having an inlet proximate the tower bottom for gently and continuously withdrawing the juice and the coagulated precipitables, thereby preventing the break up of the coagulated precipitables and the settling of the coagulated precipitables within the tower;

means for adjusting the rate at which the juice and coagulated precipitables are siphoned from the tower so as to vary the residence time of the juice within the tower; and means for removing cane sugar fibers and leaves from the surface of the juice when the level of the juice within the tower has reached a predetermined level.

* * * * *